US005279234A

United States Patent [19]

Bender et al.

[11] Patent Number: 5,279,234

[45] Date of Patent: Jan. 18, 1994

[54] CONTROLLED CLEAN-EMISSION BIOMASS GASIFICATION HEATING SYSTEM/METHOD

[75] Inventors: Robert J. Bender, South Burlington; Louis T. Bravakis, Worcester; John P. Tomasi, Bristol, all of Vt.

[73] Assignee: Chiptec Wood Energy Systems, South Burlington, Vt.

[21] Appl. No.: 956,354

[22] Filed: Oct. 5, 1992

[51] Int. Cl.[5] ..... F23B 5/00; F23K 3/00

[52] U.S. Cl. ..... 110/210; 110/101 R; 110/101 C; 110/214; 110/162; 110/229; 110/346

[58] Field of Search ..... 110/210, 211, 214, 162, 110/229, 230, 231, 346, 101 R, 101 CF. 101 C

[56] References Cited

U.S. PATENT DOCUMENTS

| | | | |
|---|---|---|---|
| 4,531,462 | 7/1985 | Payne | 110/210 |
| 4,615,283 | 10/1986 | Ciliberti et al. | 110/210 |
| 4,718,357 | 1/1988 | Wang et al. | 110/210 |
| 4,831,944 | 5/1989 | Durand et al. | 110/346 |

*Primary Examiner*—Henry C. Yuen
*Attorney, Agent, or Firm*—Donald W. Meeker

[57] ABSTRACT

A biomass fuel gasification chamber, blast tube, and heat exchange chamber are interconnected horizontally and subjected to negative drawing pressure by a large variable speed chimney fan. An auger with an air lock feeds biomass fuel automatically into the gasification chamber. Fuel is moved across the gasification chamber on a partially serrated sloping grate. Three stages of fuel activity are created: anaerobic heating for pyrolysis, combustion, and incandescent charcoal oxydation for gasification. A variable speed fan, variable flue, and directional air duct and baffles control the stages with underfire air. A programmed auger in an airtight chamber removes ash automatically. In large systems a hydraulic moving wedge floor assists the fuel feeding auger and a moving sloping grate moves the fuel. A fan and long preheating duct with baffles and fins inside the gasification chamber preheat and direct air into a blast tube leading from the gasification chamber. Openings from the preheating tube angled both longitudinally and transversely into the blast tube create turbulence in the blast tube directed away from the gasification chamber. Preheated directed air flow and the negative pressure of the chimney fan draw gases from the gasification chamber into the blast tube, crack the gases, and shoot a fire blast into the heat exchange chamber. The fire blast heats an external system. Particulates are removed producing a clean-emission exhaust gas. Temperature and air quality sensors in the chimney provide feedback signals to various system controls to maintain optimum operating conditions.

20 Claims, 2 Drawing Sheets

CONTROLLED CLEAN-EMISSION BIOMASS GASIFICATION HEATING SYSTEM/METHOD

BACKGROUND OF THE INVENTION

1. Technical Field

The present invention relates to heating systems with fuel treatment means for liberating gas from solid fuel and in particular to a controlled system and method for clean-emission variable biomass gasification and combustion.

2. Description of the Prior Art

Biomass waste provides an abundant source of fuel from what might otherwise be considered waste. In addition, the plant matter from which the biomass waste comes is a renewable resource. As long as trees and other plants are harvested ecologically they keep replacing themselves with new growth by the natural growth cycle in many forests or by replanting. In addition, using plant growth as fuel maintains the natural carbon cycle in a 100% balanced state, because the clean gasification and combustion of biomass fuel puts back into the environment the same amount of carbon that occurs in the natural decay of plants. The carbon is then taken in by the living plants. However, burning coal, oil and natural gas creates a carbon overload in the environment from the centuries of stored carbon suddenly released into the environment.

Sources for biomass waste in the form of wood chips include whole tree chips from forestry maintenance including tree tops and waste in forests, brush and tree cuttings from parks and roadways, lumber mill waste, woodworking waste, crushed palletts, and any other sources of disgarded wood or wood byproducts. Many other sources of biomass waste exist in other forms from landfill sites, municipal waste collection, waste from companies using plant matter in any form, paper waste, and many other sources. The community itself can become the source of fuel for the community's own plants burning biomass fuel.

The major problem with biomass fuel is the substantial creosote and smoke discharge normally associated with wood burning and biomass burning stoves and furnaces which burn at relatively low temperatures at low efficiency rates. As well as a pollution problem, this is a great waste or resources, because the "pollutants" given off by such stoves and furnaces are hydrocarbon gases and particulates which will all burn cleanly if burned in an efficient high temperature system.

Most stoves, furnaces, and power plants using wood and biomass fuel are set up to burn somewhat efficiently, but only with specific qualities of fuels, typically limited in an allowable range of moisture content and other criteria such as phosphate content, which creates ash. Finding sources of biomass waste that meet specific requirements of moisture content and other criteria consistently is a major problem that further limits the efficiency of other systems, thereby wasting fuel and creating considerable pollution.

In other systems, such as large power plants, burning at relatively high temperatures in very large chambers "gasification" and burning of some of the hydrocarbon gases occurs spontaneously because of the high temperatures created from a huge fire source, the explosiveness of blown-in fuel and the fact that pyrolytic gases remain in some locations within the huge chambers to eventually burn up. Because these systems are relatively static and uncontrolled they are designed for a very limited range of fuel types and qualities and therefore burn less efficiently than they were designed for much of the time because of variations in fuel quality and changing climatic conditions such as air pressure, air temperature and humidity.

Smaller scale systems such as furnaces for buildings and stoves for homes are generally less efficient than the large power plants because they don't develop the same level of gasification spontaneously, because in smaller chambers the gases generally don't remain in the system as long, the same high temperature conditions are usually not attained, and fuel sources are even less uniform than municipal systems with rigid fuel requirements.

Although some systems have some controls built in to vary air input through flues or with some provision for creating gasification and combustion of the pyrolytic gases, most systems are relatively static with no feedback means to monitor the efficiency of the system; so they fail to control the gasification and pyrolytic gas combustion for variations in fuel quality and climatic conditions. Most biomass and wood burning systems require considerable time and labor in monitoring and manual adjustments to maintain some level of efficiency, especially systems requiring manual loading of fuel and unloading of ash.

Most other biomass fuel chambers are vertically oriented with vertical stacking of the fuel and vertical release and combustion of gases. The vertical system lacks control and creates inefficient, irregular, and incomplete gasification and combustion of pyrolytic gases, producing considerable pollution and waste as well as using more fuel to produce less heat.

DISCLOSURE OF INVENTION

The present invention provides a totally controlled system and method for anaerobic pyrolysis, high temperature incandescent charcoal gasification, and very high temperature cracking and burning of all gases, producing total combustion to enable the system to burn a variety of types and qualities of biomass fuels with great efficiency (80–85%), clean-emission exhaust, and less than one percent ash.

Horizontal orientation of the gasification chamber (primary combustion chamber), blast tube (secondary combustion chamber), and heat exchanger affords greater control over each stage in the process, permitting observation, monitoring and control adjustments for every stage in the entire process.

Monitoring of the process and feedback to all control means enables the system to function efficiently under all climatic conditions and variations in fuel types and qualities (up to 60% moisture content with clean burning efficiency). This enables a wider variety of wastes to be utilized efficiently providing less expensive fuel costs and better access to fuel sources. Monitoring exhaust quality and temperature with feedback controls insures clean emission exhaust as well as efficient operation. Not only does this automated total control system produce greater efficiency and more ecologically sound operation, but it does so at considerably less cost, requiring less fuel for greater heat output and less labor cost in operating and maintaining the system.

A totally automated fuel feed system and ash removal system insures constant operation and saves considerably in labor costs, while enabling the use of a variety of types and qualities of fuel. Controlling the air quantity, heat, and direction and the flow of gases within the system creates a multi-stage process wherein pyrolytic gases are released from the solid fuel under anaerobic heating conditions, efficient gasification takes place by controlling the oxydation rate of incandescent charcoal, and then the gases are cracked and burned cleanly under controlled conditions of high heat, turbulent mixture of heated air, and strong negative drawing pressure to create a hot jet blast of flame for total burning of all gases cleanly regardless of fuel quality, especially in terms of variable moisture content. Removing ash at a controlled rate enables the use of fuels having different phosphate content, which creates the ash.

Moving and controlling biomass fuel and controlling quantity and direction of air flow to the fuel creates three stages of fuel activity in the primary combustion chamber. Limiting air to the fuel initially creates anaerobic heating for pyrolysis releasing polycyclic anaerobic hydrocarbons. Moving the fuel over openings in the grate and directing controlled air through the openings beneath the fuel creates combustion of the fuel. Controlling the amount and direction of air flow as the fuel moves along the grate creates incandescent charcoal generating high temperatures for gasification. Maintaining oxydation penetration of the incandescent charcoal at the same rate as ash removal produces very efficient combustion with less than one percent ash remaining.

Delaying gases in the primary combustion chamber, allowing anaerobic pyrolysis and char gasification, and building up temperature with controlled preheated air directed in a positive flow direction with a turbulence creating spiral in the blast tube, as well as creating a strong negative pressure draw in the blast tube at the desired time creates a very hot (1800–2400 degrees Fahrenheit) fire blast for total burning all of the gases by actually "cracking" the gases for clean burning. A large variable speed fan in the exhaust chimney creates a controllable negative pressure in the system enabling the control of gases flowing through the system. Removing small particulates from the exhaust gases with a particulate collector in the chimney leaves a clean emission exhaust released into the atmosphere.

A horizontally oriented system producing a horizontal fire blast enables this high temperature and high efficiency system to be used in many applications not possible with vertical systems or larger systems. Lengthening the gasification chamber for longer retention of pyrolytic gases and generating more heat for gasification produces more powerful systems without adding substantially to the height of the system. Small units may be used for heating boilers or other furnaces in homes, fitting in a normal cellar space, and larger units may be used to heat boilers or other furnaces in large buildings or for a variety of industrial applications such as evaporators for maple sugar production. The system may also be used in cogeneration systems alternating the biomass fuel system of the invention with an oil fired system both feeding into the same boiler or other type of furnace, by providing a special exhaust system when the oil fuel is burned.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
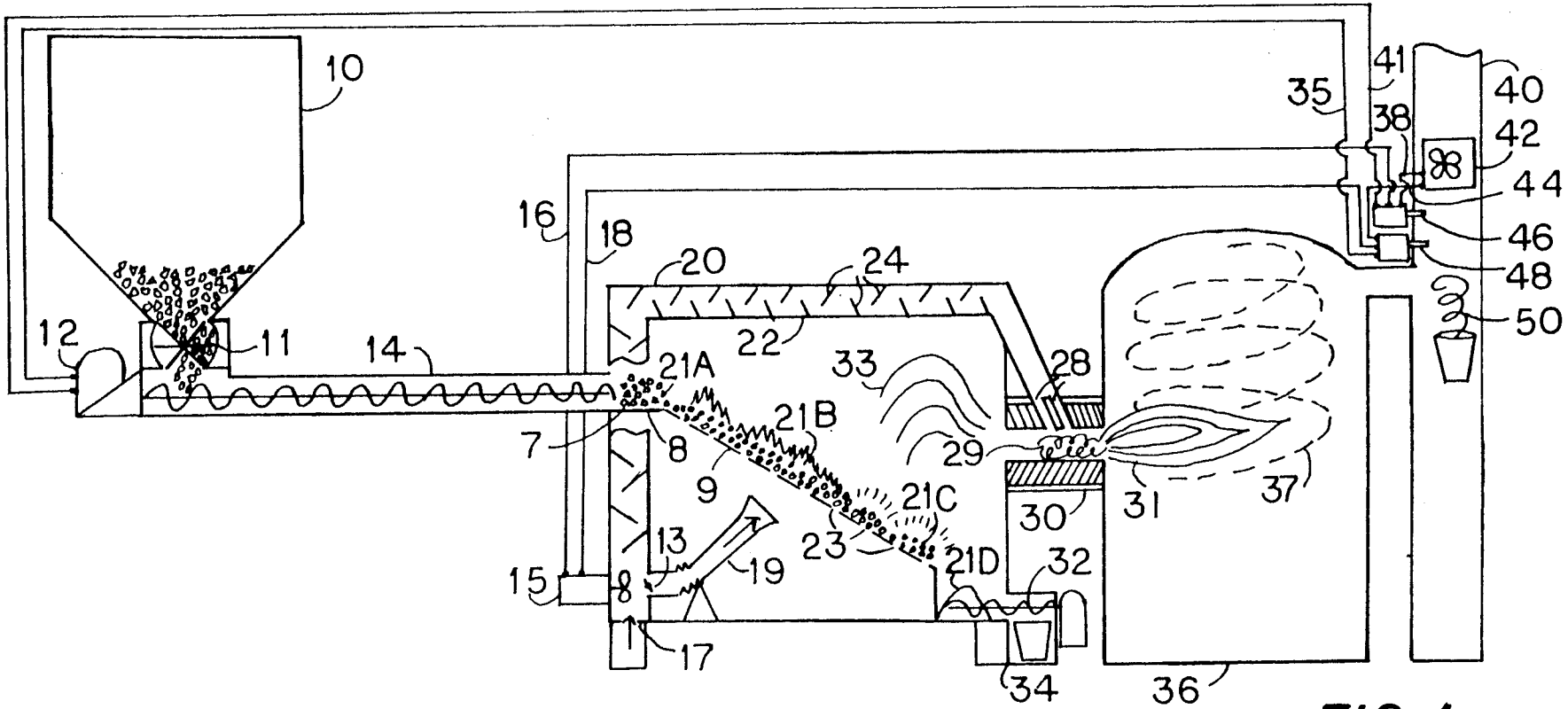
FIG. 1 is a diagrammatic elevational view of the entire system as it is used with a boiler.

In FIG. 1 a controlled clean-emission diverse biomass fueled heating system produces anaerobic pyrolysis, incandescent charcoal gasification, cracking and total gas combustion. The system comprises three main components connected horizontally: a gasification (or primary combustion) chamber 20, a horizontal blast tube 30 (or secondary combustion chamber) leading out of the primary combustion chamber, and a heat exchange chamber 36 for receiving a fire blast from the fire tube. The gasification chamber 20 uses a variety of types and qualities of biomass fuels moving across the chamber in controlled stages creating anaerobic pyrolysis, combustion and oxidation of incandescent charcoal generating high temperatures for gasification, and retention and heating of gases. The blast tube 30 receives and ignites the gases 33 from the primary combustion chamber producing cracking and total combustion of the gases to generate a fire blast at a high temperature. The heat exchange chamber 36 receives the fire blast from the blast tube and applies the fire blast to a means for applying heat produced from the system, such as boiler coils 37 (shown with dashed lines).

A variable speed auger 14 driven by an electric motor 12 is a variable means for feeding biomass fuel into the gasification chamber 20 at a controlled rate. A rotary multiple vane revolving air lock 11 connected to the auger feed is a means for limiting inflow of air where the fuel feeds into the auger 14 from the fuel bin 10 to control potential flare ups and prevent ignition of the fuel in the auger and fuel bin.

Figure 2:
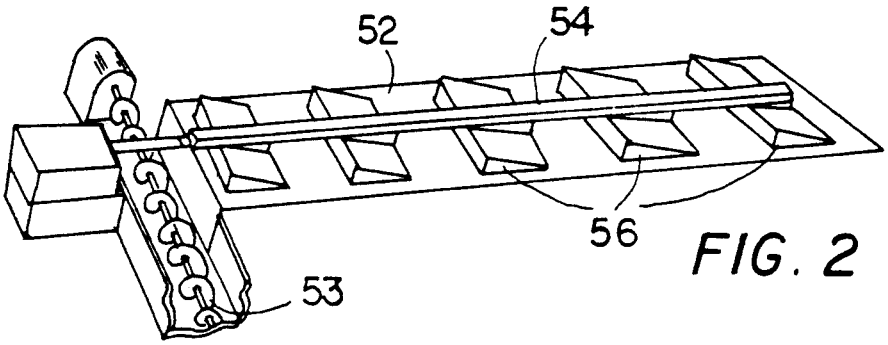
FIG. 2 is a partial perspective view of a moving floor fuel feed device for larger systems.

In FIG. 2 a variable speed reciprocating moving floor 52 in the form of a hydraulic wedge drive, having a hydraulically driven shaft 54 with a series of attached parallel wedges 56, feeds biomass fuel from a storage bin into the auger 53 at a controlled rate for large gasification systems. This auger 53 then feeds into the system of FIG. 1.

Figure 3:
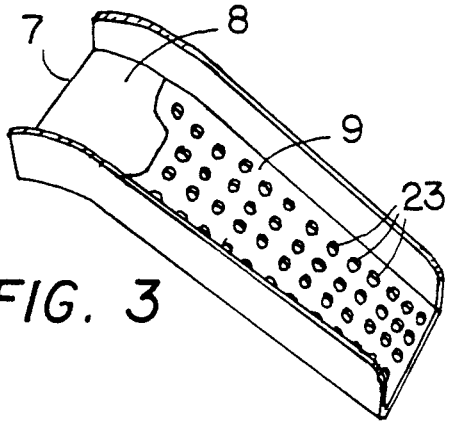
FIG. 3 is a perspective view of a sloping grate used in the gasification chamber.

In FIG. 3 a sloping grate 7, extending from the fuel feeding means across the gasification chamber, provides the means for controlling the movement of biomass fuel through the gasification chamber. The biomass fuel 21 moves down the sloping portion 9 of the grate pulled by the force of gravity and pushed by the fuel feeding means into the gasification chamber at a controllable rate. Different stages of fuel activity occur on the grate by controlling the direction and quantity of air reaching the fuel. A stationary flat shoulder 8 adjacent the fuel feeding means isolated from the flow of underfire air by a solid airtight base forms a means for heating the biomass fuel 21A for anaerobic pyrolysis, releasing polycyclic anaerobic hydrocarbons. A variable speed fan 15 directing air into the gasification chamber from outside through a variable air vent opening 13 and variously sized and shaped openings 23 in the sloping portion 9 of the grate beneath the biomass fuel 21B form a means for controlling the volume of underfire air flow beneath the biomass fuel thereby controlling the heating of the biomass fuel, the combusting of the biomass fuel, and the oxydizing of the biomass fuel as incandescent charcoal 21C into ash 21D, wherein the oxydation of the incandescent charcoal produces high temperatures for gasification. Movable air conduits 19 and baffles guide the direction of the air flow below the biomass fuel and serve as a directing means for controlling underfire air beneath the biomass fuel and thereby controlling the stages of activity. To begin combustion of moister fuel, after the fuel moves from the shoulder 8 onto the perforated grate 9, underfire air should be directed at the fuel higher up on the grate than with dryer fuels which begin combustion more easily. Maintaining the oxydation penetration into the incandescent charcoal at the same rate as the ash removal leaves less than one percent ash and produces high temperatures efficiently for gasification of the fuel.

Figure 4:
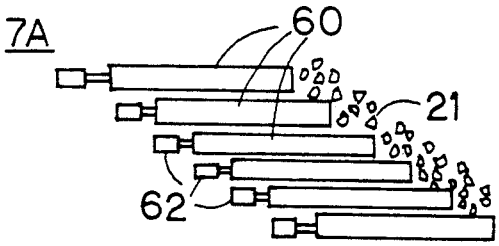
FIG. 4 is a diagrammatic elevational view of a moving grate used in larger systems.

In FIG. 4 for larger systems the means for controlling the movement of biomass fuel 21 through the gasification chamber comprises a series of variable speed moving grates 60, which are driven by hydraulic pistons 62, and which grates slope downwardly across the gasification chamber from the fuel feeding means.

The means for the controlled removal of ash from the gasification chamber comprises a pit below the bottom of the grate to collect ash 21D as the ash drops off of the grate and an auger 32 in an air sealed box 34, which auger moves the ash out of the gasification chamber at a programmed rate based upon phosphate content of the fuel which creates the ash and the oxydation rate of the incandescent charcoal.

A horizontal blast tube 30 (secondary combustion chamber), a cylidrical steel tube lined with ceramic board insulation and refractory brick leads horizontally out of the gasification chamber through a wall opposite the fuel feeding means. The means for controlling the temperature, volume, and direction of preheated air flow into the blast tube and turbulence in the blast tube comprises a series of air inlets 28 into the blast tube angled both longitudinally and transversely to direct air flow away from the gasification chamber in a spiral pattern around the interior of the blast tube creating turbulence 29 within the blast tube for better mixing of the preheated air with the gases 33 which are drawn into the blast tube.

A preheat combustion air duct 22 extends within the gasification chamber from a base of the gasification chamber adjacent to the biomass fuel feed means up along a top of the gasification chamber across the gasification chamber to outlets 28 leading into the blast tube. A variable speed fan 15 blows air into the preheat duct, wherein a series of baffles and fins 24 inside the preheat duct delay and control the flow of air into the preheat duct to control, along with the variable speed fan, the volume and temperature of the preheated combustion air directed into the blast tube.

A means for controlling the air pressure throughout the system comprises a variable speed fan 42 in the exhaust chimney 40, which fan is sufficiently large to create a negative pressure in the entire system, thereby controlling the flow of gases through the system. This negative pressure drawing on the blast tube along with the input of preheated air directed into the blast tube and the sudden explosive combustion of the gases mixed with the preheated air creates a horizontal fire blast 31 which shoots into the heat exchange chamber 36 to generate substantial heat (1800–2400 degrees Fahrenheit with wood chip fuel).

The heat exchange chamber 36 may be any heat chamber where the generated heat may be applied to a system requiring heat through a heat transfer means such as boiler coils 37 as indicated by dashed lines in FIG. 1.

After the majority of the heat is used by the heat transfer means the exhaust gas is then drawn up the chimney 40 and dispersed into the atmosphere. Although the exhaust gas under the controlled conditions of the present system is virtually void of all pollutant gases which have been burned up by the secondary combustion, any particulates drawn into the chimney with the gas are removed by a particulate collector 50 which spins exhaust air from the heat exchange chamber and traps particulates which fall out and are collected to leave a clean-emission exhaust.

A pyrometer 44 in the chimney adjacent to an exhaust outlet from the heat exchange chamber provides a means for monitoring temperature of exhaust gases. Means for sending feedback signals from the pyrometric monitoring means comprise an electric control signal on a wire 16 from the pyrometer to the means for controlling air volume, on a wire 41 from the pyrometer to the means for controlling fuel feeding, and on a wire 38 from the pyrometer to the means for controlling air pressure.

A means for monitoring air quality of exhaust gases comprises a detector 48 in the exhaust chimney 40 for detecting the presence of any undesirable uncombusted gases, such as carbon monoxide in the exhaust from the heat exchange chamber. Means for sending feedback signals from the monitoring means comprise an electric control signal on a wire 18 from the detector to the means for controlling air volume, on a wire 35 from the detector to the means for controlling fuel feeding, and on a wire 44 from the detector to the means for controlling air pressure.

Feedback from the pyrometer and detector to the various control means enables fine tuning of the system to maintain optimum operation responsive to varying fuel, climatic conditions, and any other variables that might affect efficiency of the system. A normal thermostat may also be linked to the controls to activate and deactivate the system in response to heat needs.

Manual adjustments may be made as desired from observations of the temperatures, emission quantity, and flame color at different stages in the process.

The method involved in the controlled clean-emission diverse biomass gasification and combustion heating method comprises a number of coordinated and controlled steps for clean and efficient operation.

Any of a variety of types and qualities of biomass fuel are fed by the variable fuel feeding auger at a controlled rate into the biomass fuel gasification chamber for anaerobic pyrolysis, combustion and oxidation of incandescent charcoal generating high temperatures for gasification, and retention and heating of gases. The inflow of air during the fuel feeding is restricted with a rotating airlock connected to the fuel feeding means where the fuel feeds into the auger from a fuel bin to control potential flare ups and prevent ignition of the fuel in the auger and fuel bin.

Movement of the biomass fuel through the gasification chamber is controlled and underfire air is controlled to create three different stages of activity of the biomass fuel. The biomass fuel is heated anaerobically for anaerobic pyrolysis, releasing polycyclic anaerobic hydrocarbons, by restricting underfire air flow beneath the biomass fuel on a solid horizontal shoulder portion of the grate. Underfire air is then introduced through holes in the sloping portion of the grate to create combustion of the biomass fuel. Oxydizing the biomass fuel as incandescent charcoal into ash is then achieved by directing and controlling the volume of underfire air flow beneath the biomass fuel with underfire air flow volume control means and underfire air flow direction control means and controlling the speed of the biomass fuel movement through the gasification chamber with the variable biomass fuel feed means pushing the fuel and gravity pulling according to the slope of the grate. In large systems a moving grate controls the movement of the fuel. Maintaining the oxydation penetration into the incandescent charcoal at the same rate as the ash removal leaves less than one percent ash and produces high temperatures efficiently for gasification of the fuel.

The ash is removed from the gasification chamber at a programmed rate with a controlled ash removal means without admitting air into the gasification chamber. The programmed rate of ash removal is based upon phosphate content of the fuel which creates the ash and the oxydation rate of the incandescent charcoal.

After sufficient accumulation and heating time in the gasification chamber, gases are drawn from the gasification chamber into the horizontal blast tube leading out of the gasification chamber while controlling the preheated air flow temperature, volume, and direction leading into the blast tube, and the turbulence in the blast tube by a series of preheated air inputs angled longitudinally and transversely into the fire tube. A controlled vacuum created by the large variable speed chimney fan also acts strongly in drawing the gases into the blast tube and drawing the hot jet blast of high temperature burning gases into the heat exchange chamber leading out of the blast tube.

Substantial heat is then transferred from the heat exchange chamber to another system such as a boiler, evaporator, or other system requiring heat.

Clean-emission exhaust gases are drawn from the heat exchange chamber into an exhaust chimney and out into the atmosphere. Particulates are collected from the exhaust gases with a rotating particulate collecting means in the exhaust chimney.

Temperature and chemical quality of exhaust gases are monitored in the chimney and feedback signals are sent from the monitoring means to adjust the various control means for the system.

Temperature monitoring of the various stages and processes indicates efficient ranges for wood chip fuel to be about 370 degrees Fahrenheit for initial anaerobic pyrolysis, 980 degrees Fahrenheit for the incandescent charcoal gasification, 1200 degrees Fahrenheit in the blast tube producing a jet blast 1800–2400 degrees Fahrenheit for the heat exchange chamber, and 350–450 degrees Fahrenheit for the chimney exhaust. System outputs range from 500,000 BTU/hr at 15 HP burning 70–118 lbs/hr with wood chip fuel ranging from 10% to 40% moisture content to 6,290,000 BTU/hr at 185 HP burning 884–1480 lbs/hr of wood chip fuel ranging from 10% to 40% moisture content. Other sizes of systems are possible using the same system and method.

It is understood that the preceding description is given merely by way of illustration and not in limitation of the invention and that various modifications may be made thereto without departing from the spirit of the invention as claimed.

We claim:

1. A controlled clean-emission diverse biomass gasification and combustion heating system comprising a gasification chamber for anaerobic pyrolysis, combustion, and incandescent charcoal gasification of a variety of types and qualities of biomass fuels with a means for controlling underfire air volume input, a means for directing underfire air flow, a means for controlling rate of oxidation of incandescent charcoal and a means for retaining and heating gases within the gasification chamber;

a variable means for feeding biomass fuel into the gasification chamber at a controlled rate;

a means for limiting inflow of air through the fuel feeding means connected to the fuel feeding means;

means for controlling the movement of biomass fuel through the gasification chamber and means for controlling stages of activity of the biomass fuel: means for heating the biomass fuel for anaerobic pyrolysis by restricting underfire air flow beneath the biomass fuel, means for heating the biomass fuel, combusting the biomass fuel, and oxydizing the biomass fuel as incandescent charcoal into ash producing gasification by directing and controlling the volume of underfire air flow beneath the biomass fuel and the speed of the biomass fuel movement through the gasification chamber;

a means for the controlled removal of ash from the gasification chamber without admitting air into the gasification chamber;

a horizontal blast tube leading out of the gasification chamber for receiving and igniting gases from the gasification chamber, cracking the gases and creating a fire blast out of the blast tube;

means for controlling the temperature, volume, and direction of preheated air flow into the blast tube and turbulence in the blast tube;

a heat exchange chamber for receiving the fire blast from the blast tube and for housing a means for applying heat produced from the system;

an exhaust chimney for receiving clean-emission exhaust gases from the heat exchange chamber and exhausting them out into the atmosphere;

a means for collecting particulates from the exhaust gases;

a means for monitoring temperature of exhaust gases;

a means for monitoring air quality of exhaust gases;

a means for controlling the air pressure throughout the system, thereby controlling the flow of gases through the system;

means for sending feedback signals from the monitoring means to adjust the control means for the system.

2. The invention of claim 1 wherein the means for feeding biomass fuel into the gasification chamber at a controlled rate comprises a variable speed auger and the means for limiting inflow of air at the fuel feeding means comprises a rotary multiple vane revolving air lock connected to the auger feed.

3. The invention of claim 2 further comprising a variable speed reciprocating moving floor in the form of a hydraulic wedge drive which feeds biomass fuel from a storage bin into the auger at a controlled rate.

4. The invention of claim 1 wherein means for controlling the movement of biomass fuel through the gasification chamber comprise a sloping grate across the gasification chamber from the fuel feeding means, down which grate the biomass fuel moves pulled by the force of gravity and pushed by the fuel feeding means into the gasification chamber at a controllable rate.

5. The invention of claim 1 wherein means for controlling the movement of biomass fuel through the gasification chamber comprise a series of variable speed hydraulic grates sloping downwardly across the gasification chamber from the fuel feeding means.

6. The invention of claim 1 wherein means for controlling stages of activity of the biomass fuel comprise:

a stationary flat shoulder adjacent the fuel feeding means isolated from the flow of underfire air by a solid air tight base form a means for heating the biomass fuel anaerobically for pyrolysis;

a variable speed fan directing air into the gasification chamber from outside through a variable air vent opening and variously sized and shaped openings in a grate beneath the biomass fuel form a means for controlling the volume of underfire air flow beneath the biomass fuel thereby controlling the heating of the biomass fuel, the combusting of the biomass fuel, and the oxydizing of the biomass fuel as incandescent charcoal into ash producing gasification, maintaining the oxydation penetration into the incandescent charcoal at the same rate as the ash removal leaving less than one percent ash;

movable air conduits and baffles guiding the direction of the air flow below the biomass fuel are a directing means for controlling underfire air beneath the biomass fuel and thereby controlling the stages of activity.

7. The invention of claim 1 wherein the means for the controlled removal of ash from the gasification chamber comprises a pit to collect ash as the ash drops off of the biomass fuel moving means and an auger in an air sealed box, which auger moves the ash out of the gasification chamber at a programmed rate.

8. The invention of claim 1 wherein the horizontal blast tube leading out of the gasification chamber comprises a cylindrical steel tube lined with ceramic board insulation and refractory brick leading horizontally out of the gasification chamber through a wall opposite the fuel feeding means, and the means for controlling the temperature, volume, and direction of preheated air flow into the blast tube and turbulence in the blast tube comprises a series of air inlets into the blast tube angled both longitudinally and transversely to direct air flow away from the gasification chamber in a spiral pattern around the interior of the blast tube creating turbulence in the blast tube.

9. The invention of claim 8 further comprising a preheat combustion air duct within the gasification chamber from a base of the gasification chamber adjacent to the biomass fuel feed means and extending up along a top of the gasification chamber across the gasification chamber to outlets leading into the blast tube and a variable speed fan for blowing air into the preheat duct, wherein a series of baffles and fins inside the preheat duct delay and control the flow of air into the preheat duct to control along with the variable speed fan the volume and temperature of the preheated combustion air directed into the blast tube.

10. The invention of claim 1 wherein the means for applying heat produced from the system comprises a heat transfer means connected to an external system requiring a heat source.

11. The invention of claim 1 wherein the means for collecting particulates from the exhaust gases comprises a particulate collector which spins exhaust air from the heat exchange chamber and traps particulates which fall out and are collected.

12. The invention of claim 1 wherein the means for monitoring temperature of exhaust gases comprises a pyrometer in the exhaust chimney adjacent to the secondary combustion chamber and a means for sending feedback signals from the monitoring means comprises an electric control signal from the pyrometer to the means for controlling air volume and direction and to the means for controlling fuel feeding and to the means for controlling air pressure.

13. The invention of claim 1 wherein the means for monitoring air quality of exhaust gases comprises a detector in the exhaust chimney for detecting the presence of any undesirable uncombusted gases in the exhaust from the heat exchange chamber and a means for sending feedback signals from the monitoring means comprises an electric control signal from the detector to the means for controlling air volume and direction and to the means for controlling fuel feeding and to the means for controlling air pressure.

14. The invention of claim 1 wherein the means for controlling the air pressure throughout the system comprises a variable speed fan in the exhaust chimney sufficiently large in size to create a negative pressure in the entire system, thereby controlling the flow of gases through the system.

15. A controlled clean-emission diverse biomass gasification and combustion heating method comprising feeding any of a variety of types and qualities of biomass fuel with a variable fuel feeding means at a controlled rate into a biomass fuel gasification chamber for anaerobic pyrolysis, combustion, and incandescent charcoal gasification of the biomass fuel;

limiting inflow of air during the fuel feeding with an air inflow limiting means connected to the fuel feeding means;

controlling the movement of biomass fuel through the gasification chamber with a variable biomass fuel feed means and controlling stages of activity of the biomass fuel: heating the biomass fuel anaerobically for pyrolysis by restricting underfire air flow beneath the biomass fuel with an underfire air restricting means, combusting the biomass fuel and oxydizing the biomass fuel as incandescent charcoal into ash producing gasification by directing and controlling the volume of underfire air flow beneath the biomass fuel with underfire air flow volume control means and underfire air flow direction control means and controlling the speed of the biomass fuel movement through the gasification chamber with the variable biomass fuel feed means;

removing ash from the gasification chamber with a controlled ash removal means without admitting air into the gasification chamber;

receiving and igniting gases from the gasification chamber in a horizontal blast tube leading out of the gasification chamber while controlling the air flow temperature, volume, and direction leading into the blast tube, and the turbulence in the blast tube to crack the gases and create a fire blast leading out of the blast tube;

receiving the fire blast of high temperature burning gases in a heat exchange chamber leading out of the blast tube and applying heat produced from the system;

exhausting clean-emission exhaust gases from the heat exchange chamber into an exhaust chimney and out into the atmosphere;

collecting particulates from the exhaust gases with a particulate collecting means in the exhaust chimney;

monitoring temperature of exhaust gases with a pyrometric monitoring means;

monitoring air quality of exhaust gases;

controlling the air pressure throughout the system with an air pressure control means thereby controlling the flow of gases through the system;

sending feedback signals from the monitoring means to adjust the control means for the system.

16. The method of claim 15 wherein the methods for controlling stages of activity of the biomass fuel comprise:

heating the biomass fuel anaerobically to create pyrolysis by isolating the biomass fuel from the flow of underfire air by retaining the biomass fuel on a solid air tight base forming a stationary flat shoulder adjacent the fuel feeding means;

combusting the biomass fuel and oxydizing the biomass fuel as incandescent charcoal into ash producing gasification using a variable speed fan to direct air into the gasification chamber from outside through a variable air vent opening and variously sized and shaped openings in a grate beneath the biomass fuel thereby controlling the volume of underfire air flow beneath the biomass fuel and maintaining the oxydation penetration into the incandescent charcoal at the same rate as the ash removal leaving less than one percent ash;

directing and controlling the volume of underfire air by using conduits and baffles to guide the direction of the air flow below the biomass fuel and thereby controlling the stages of activity.

17. The method of claim 15 wherein controlling air flow temperature, volume, and direction and turbulence in the blast tube comprises blowing air with a variable speed fan into a preheat combustion air duct within the gasification chamber from a base of the gasification chamber adjacent to the biomass fuel feed means and extending up along a top of the gasification chamber across the gasification chamber to outlets leading into the blast tube, controlling the flow of air in the preheat duct by a series of baffles and fins inside the preheat duct to delay and control the flow of air in the preheat duct and thereby control, along with the variable speed fan, the volume and temperature of the preheated combustion air directed into the blast tube, directing air flow in the blast tube away from the gasification chamber and creating turbulence by blowing preheated air from the preheat duct through a series of air inlets in the blast tube into the blast tube angled both longitudinally and transversely to direct air flow away from the gasification chamber in a spiral pattern around the interior of the blast tube creating turbulence, and drawing the gas and preheated air mixture through the blast tube by creating a negative pressure with a variable speed fan in the chimney.

18. The method of claim 15 wherein monitoring temperature of exhaust gases comprises gauging temperature with a pyrometer in the exhaust chimney adjacent to the heat exchange chamber and sending feedback signals from the monitoring means comprises sending electric control signals from the pyrometer to the means for controlling underfire and preheat air volume and direction and to the means for controlling fuel feeding and to the means for controlling air pressure to maintain appropriate exhaust temperatures for optimum operating efficiency.

19. The method of claim 15 wherein monitoring air quality of exhaust gases comprises monitoring the exhaust gases using a detector in the exhaust chimney for detecting the presence of any undesirable uncombusted gases in the exhaust from the heat exchange chamber and sending feedback signals from the monitoring means comprises sending electric control signals from the detector to the means for controlling underfire and preheat air volume and direction and to the means for controlling fuel feeding and to the means for controlling air pressure to maintain appropriate exhaust clean emission standards for optimum operating efficiency.

20. The method of claim 15 wherein controlling the air pressure throughout the system comprises creating a negative pressure in the entire system with a variable speed fan in the exhaust chimney sufficiently large in size to create a negative pressure in the entire system, thereby controlling the flow of gases through the system.

* * * * *